United States Patent [19]

Roberts, Jr.

[11] 4,099,556

[45] Jul. 11, 1978

[54] VARIABLE THERMAL CONDUCTANCE REFLUX HEAT PIPE

[76] Inventor: Charles C. Roberts, Jr., 27 W. 776 Greenview, Warrenville, Ill. 60555

[21] Appl. No.: 799,454

[22] Filed: May 23, 1977

[51] Int. Cl.[2] ..... F28D 15/00

[52] U.S. Cl. ..... 165/96; 165/45; 165/105; 237/1 A

[58] Field of Search ..... 165/96, 105

[56] References Cited

U.S. PATENT DOCUMENTS

| | | | |
|---|---|---|---|
| 2,402,415 | 6/1946 | Kogel et al. | 165/105 X |
| 3,604,503 | 9/1971 | Feldman, Jr. et al. | 165/96 |
| 3,688,838 | 9/1972 | Sturm et al. | 165/96 |
| 3,837,394 | 9/1974 | Roberts, Jr. | 165/96 X |

*Primary Examiner*—Albert W. Davis, Jr.

*Attorney, Agent, or Firm*—Kegan, Kegan & Berkman

[57] ABSTRACT

A thermal energy transfer device having controllably variable thermal conductance comprises a reflux heat pipe having a capillary wick therein, an evaporator and a condenser zone, a circulating supply of working fluid which is controlled by a bendable section in the heat pipe body and an external device to control the bend in the heat pipe body, thereby controlling the amount of liquid returning to the evaporator. As returning liquid condensate is trapped in the center of the deformed tube, less liquid is available for evaporation in the evaporator. This results in a low liquid level that saturates only a portion of the evaporator wick. This results in higher thermal impedance. If the heat pipe body is deformed so that all liquid is trapped in the deformed portion, no liquid is available in the evaporator and there is a high thermal impedance.

4 Claims, 3 Drawing Figures

VARIABLE THERMAL CONDUCTANCE REFLUX HEAT PIPE

BACKGROUND OF THE INVENTION

This invention relates to devices that transfer heat from a heat source to a heat sink by means of a closed internal evaporation-condensation cycle. Heat pipes have long been known in the art. A typical heat pipe utilizes a closed vessel, containing a wick and working fluid. As heat is applied to one end of the heat pipe called the evaporator, the liquid vaporizes, and as vapor pressure builds, vapor is driven to the cooling area, called the condenser, where the vapor condenses. The resulting liquid condensate then returns by capillary action or by gravity to the evaporator to be used to repeat the cycle. The resultant structure is characterized by high thermal conductance and very low temperature drop.

The interior of the heat pipe normally contains a wick extending throughout its entire length. However, certain designs that rely on a gravity liquid return system may require a wick only in the evaporator to uniformly distribute the liquid. The free space inside the structure is the vapor passage and must be kept clear for efficient flow of vapor from the evaporator to the condenser.

In many heat pipe applications it is advantageous to control the thermal impedance of the device. For example, the heat coming from a solar collector may be required in the winter but not in the summer. Therefore, in the summer, the controllably variable conductance heat pipe would be turned off. When the heating season arrives, energy from the solar collector will be needed and the variable conductance heat pipe can be turned on. Another application of a variable conductance heat pipe is in the utilization of energy escaping in the flue stack from a home furnace. The variable conductance heat pipe can conduct the heat (waste heat) to the sidewalk and remove ice in the winter. It is disadvantageous however, to allow the heat pipe to run continuously since this does remove heat from the flue gas exhaust and may allow flue gas cooling below the dew point resulting in condensate accumulation. The variable conductance heat pipe can be actuated only when necessary so that furnace damage due to condensates from the flue gas is minimized.

SUMMARY OF THE INVENTION

This invention relates to a reflux heat pipe having a deformable zone and a circulating supply of working fluids whose circulation is controlled by bending or deforming the heat pipe to provide a trap in the deformable portion of the heat pipe. The inner section of the hot or evaporating end of the heat pipe is composed of various wick slab structures that end at different depths in the liquid puddle in the evaporator. When the evaporator is full of liquid all wicks are saturated because the liquid surface contacts them. When the heat pipe body is in the "on" or undeformed position, liquid is allowed to return freely to the evaporator puddle and heat is transferred readily from the evaporator to the condenser. This is called the "on" mode. Should higher thermal impedance be desired in this heat transfer apparatus the heat pipe body can be deformed slightly resulting in a partial liquid trap. Since this liquid trap prevents a portion of the total evaporator liquid from returning, the evaporator puddle reduces in depth and does not contact all the wick slabs in the evaporator. This results in desaturation and loss of liquid to portions due to evaporation. Since there is less liquid available circumferencially to wet the evaporator there is a higher thermal impedance at the same heat flux. This is called the "variable conductance" mode of operation. Should no heat transfer be desired, the heat pipe body can be deformed to its maximum to trap all the liquid in the middle of the deformed heat pipe body. No liquid returns to the evaporator and the evaporation condensation is effectively interrupted. Accordingly, no heat transfer takes place. This is the third mode of operation called the "off" mode.

BRIEF DESCRIPTION OF THE DRAWING

This invention will be better understood from consideration of the drawings in conjunction with the following detailed description.

Figure 1:
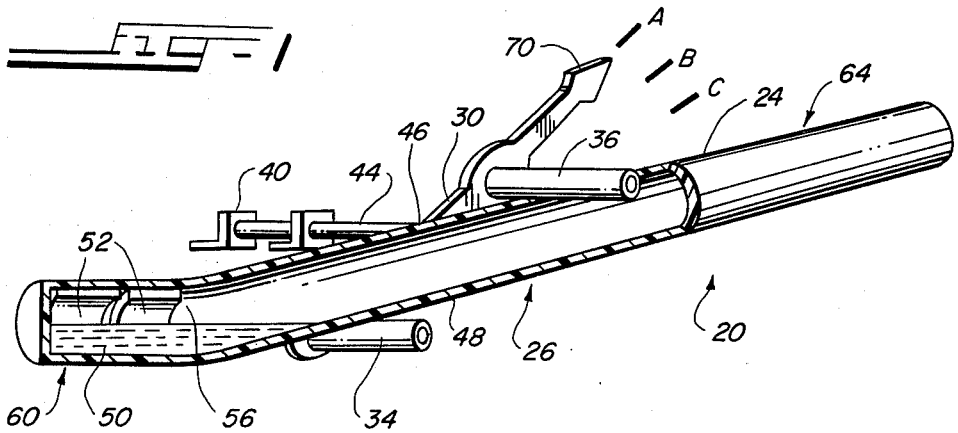
Figure 2:
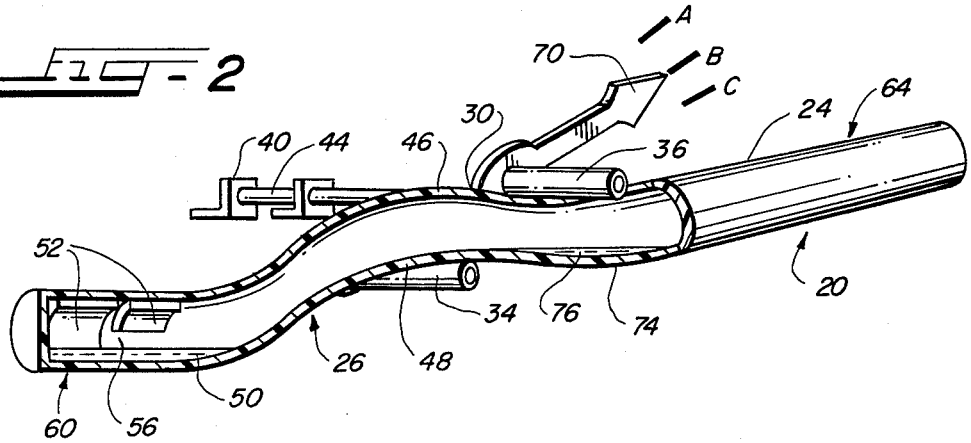
Figure 3:
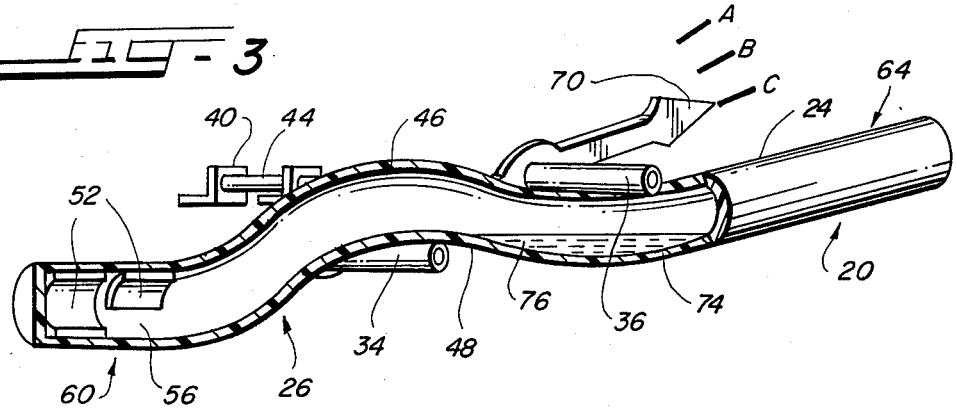

IN THE DRAWINGS:

FIG. 1 is a perspective view of the variable conductance heat pipe of the invention with portions cut away to show the liquid phase distribution in the device for the "on" mode of operation;

FIG. 2 is a view similar to that of FIG. 1 but showing the heat tube bent to trap a portion of the liquid as occurs in the "variable conductance" mode of operation; and FIG. 3 shows the heat pipe of the invention deformed to trap substantially all of the liquid, to interrupt operation and to establish the "off" mode.

DESCRIPTION OF PREFERRED EMBODIMENT

Referring now to the drawings, there is depicted, for purposes of illustrative disclosure, a preferred embodiment of the thermal energy transfer device of the invention. Portions of the drawings have been cut away to expose inner surfaces.

As shown, the reflux heat pipe device 20 includes an uninterrupted pipe 24 which incorporates a deformable adiabatic zone 26. The heat pipe 24, serving as the main channel for liquid return flow and vapor flow, is closed at each end.

A pipe deforming assembly 28 includes a lever 30 and a pair of spaced arms 34 and 36 which bridge the pipe 24 in its deformable center or adiabatic zone 26. The arms 34 and 36 are mounted 40 on a pivotal shaft 44 so that they will contact and stressingly bear upon opposed upper 46 and lower 48 surfaces of the deformable zone 26 to effect a distortion or inflection in the zone 26 in a vertical plane when the shaft 44 is rotated.

In the normal "on" mode of operation the pipe 24 contains a liquid puddle 50 which contacts an array of slab wicks 52 bonded to an internal surface 56 in an evaporator zone 60 of the device. When heat is applied at the evaporator zone 60k vapor is liberated from the wicks 52 and is driven by a pressure gradiant to a condenser zone 64 displaced upwardly from the evaporator zone 60. Vapor is condensed to liquid and returns by gravity to the liquid puddle 50.

The degree of deformation of the deformable section 26 is selectively adjustable and is shown on an indicator 70 correlated with three different operation modes, A,B, or C. With the deformation lever 30 positioned so that the indicator 70 points to A or the "on" mode normal heat transfer results (FIG. 1).

In FIG. 2 the deformation apparatus indicator is in the B position correlated with the variable conductance mode. The adiabatic section 26 is thus deformed to define a liquid trap 74 in the deformable zone 26 and liquid 76 collects. Accordingly, there is a liquid deficiency in the evaporator zone 60 which exposes one of the wick slabs 52 resulting in desaturation of that slab, since no liquid can be wicked. This reduction in wetted wicking area results in higher thermal impedance since heat now must be transferred from a smaller portion of the evaporator.

In FIG. 3, the deforming apparatus is moved into position C which results in a greater degree of deformation of the adiabatic section 26 and a larger amount of liquid is trapped. In the case illustrated, all the liquid is trapped in the adiabatic section 26 and there is no liquid puddle in the evaporator. The result is cessation of the liquid evaporation-condensation cycle. This represents the "off" mode of the variable conductance heat pipe.

What is claimed is:

1. Thermal transfer apparatus comprising reflux heat pipe means, said heat pipe means including:

an evaporator section, slab wicks of various depths disposed in said evaporator section for contacting a liquid puddle in said evaporator section of said pipe means, an adiabatic center section and an upper condenser section, said adiabatic center section having a deformable zone, closure means sealing said pipe means at each end, a vaporizable liquid in said apparatus, said liquid being in equilibrium with a vapor phase thereof, and mechanical means for deforming said deformable adiabatic section to provide an inflection in said central section of said pipe means.

2. The apparatus as set forth in claim 1 wherein said heat pipe means contains liquid in a limited quantity which is less than that which can totally be trapped in said deformable zone.

3. The apparatus as set forth in claim 1 wherein said means for deforming said adiabatic section is selectively positionable to adjust the degree of infection in said pipe means, thereby to vary the quantity of liquid trapped, to establish a deficiency of liquid in said evaporator to effect partial saturation of said evaporator slab wicks and to provide variable thermal conductance.

4. The apparatus as set forth in claim 2 wherein said means for deforming said center section comprises lever means including a pair of spaced arms disposed to bridge said pipe means at said deformable zone for engaging said pipe means at longitudinally spaced upper and lower surfaces thereof, and shaft means for pivoting said lever and said arms to achieve selectable deformation of said adiabatic section of said apparatus to regulate the quantity of water trapped in said deformable zone.

* * * * *